US011024134B2

(12) United States Patent
Needham

(10) Patent No.: US 11,024,134 B2
(45) Date of Patent: Jun. 1, 2021

(54) SYSTEMS AND METHODS TO ALLOW OPERATORS TO SENSE DISTANCE AND/OR DIRECTION USING HAPTIC FEEDBACK

(71) Applicant: Aurora Flight Sciences Corporation, a subsidiary of The Boeing Company, Manassas, VA (US)

(72) Inventor: Thomas Needham, Cambridge, MA (US)

(73) Assignee: Aurora Flight Sciences Corporation, a subsidiary of The Boeing Company, Manassas, VA (US)

( * ) Notice: Subject to any disclaimer, the term of this patent is extended or adjusted under 35 U.S.C. 154(b) by 0 days.

(21) Appl. No.: 16/572,110

(22) Filed: Sep. 16, 2019

(65) Prior Publication Data

US 2021/0082261 A1 Mar. 18, 2021

(51) Int. Cl.
*G08B 6/00* (2006.01)
*G08B 21/02* (2006.01)

(52) U.S. Cl.
CPC ..... *G08B 6/00* (2013.01); *G08B 21/02* (2013.01)

(58) Field of Classification Search
CPC ..... G08B 6/00; G08B 21/02
See application file for complete search history.

(56) References Cited

U.S. PATENT DOCUMENTS

| | | | | |
|---|---|---|---|---|
| 9,074,884 | B2 | 7/2015 | Buchel | |
| 10,275,025 | B2 | 4/2019 | Black et al. | |
| 10,345,909 | B2 | 7/2019 | Levesque et al. | |
| 10,359,857 | B2 | 7/2019 | Levesque | |
| 10,475,298 | B1 * | 11/2019 | Werner | H01R 13/465 |
| 2016/0274662 | A1 * | 9/2016 | Rimon | G06F 3/016 |
| 2017/0131773 | A1 * | 5/2017 | Keller | G06F 3/017 |
| 2017/0133792 | A1 * | 5/2017 | Werley | H01R 13/7038 |
| 2018/0001192 | A1 * | 1/2018 | Vaughn | A63F 13/285 |
| 2018/0004290 | A1 * | 1/2018 | Shtraym | G06F 3/017 |

* cited by examiner

*Primary Examiner* — Sisay Yacob
(74) *Attorney, Agent, or Firm* — Mh2 Technology Law Group LLP

(57) ABSTRACT

Provided herein are systems to allow an operator to sense, for example, distance of a component from a component connector. The systems include a transmitter associated with the component connector, and a feedback device operable to contact the operator. The feedback device comprises a receiver operable to receive signals transmitted by the transmitter, and an actuator operable to provide haptic feedback to the operator in which, for example, strength, manner, or strength and manner of actuation of the actuator is determined by strength of the signals received by the receiver. Typically, the systems further allow the operator to engage the component to the component connector. Other aspects of the present disclosure provide various methods of allowing an operator to sense, for example, distance of a component from a component connector and to related computer readable media.

27 Claims, 4 Drawing Sheets

SYSTEMS AND METHODS TO ALLOW OPERATORS TO SENSE DISTANCE AND/OR DIRECTION USING HAPTIC FEEDBACK

FIELD

The subject matter described herein generally relates to the field of user interface systems. More particularly, the subject matter disclosed herein relates to object sensing and manipulation using haptic feedback.

BACKGROUND

Aerospace and aircraft manufacture and maintenance typically involves long lengths, possibly miles, of cables and wire routed throughout spaces within the airframes. As those routing spaces fill up and as airframes become more intricate, the available space for installers becomes limited. Routing cables is typically done by hand and often relies on the spatial awareness or perceptive acuity of technicians in difficult positions. Oftentimes, there may be no visual line of sight, thus necessitating the use of additional and sometimes awkward visual equipment such as mirrors or borescopes to view aerospace and/or aircraft components. Further, technicians frequently need to assume awkward positions before extending an arm, other body part, or tool to route, for example, a given cable, harness jacket, sleeving, or terminating connector, making discerning one cable or other aerospace and/or aircraft component part from another extremely difficult. Thus, there is a need for a user interface or system that gives a user feedback about the relative distance and/or direction to a given target component during aerospace and/or aircraft assembly and maintenance, as well as during other aerospace and/or aircraft applications.

Aside from aerospace-related uses, other exemplary applications of the systems described herein include providing line voltage warnings to electricians as well as use in automotive, home improvement, manufacturing assembly line, underground electrical, and other general mechanical installations, removals, and/or repairs.

SUMMARY

The present disclosure is directed to systems and related methods to allow operators to sense distance and/or direction. Typically, these systems and related methods involve the use of haptic feedback or effect.

In one aspect, the present disclosure provides a system, and for example, a haptic feedback system to allow an operator to sense distance of a component (e.g., an aerospace and/or aircraft component) from a component connector (e.g., another aerospace and/or aircraft component, respectively). The system or haptic feedback system includes a transmitter associated with the component connector, and a feedback device operable to contact the operator. The feedback device comprises a receiver operable to receive signals transmitted by the transmitter, and an actuator operable to provide haptic feedback to the operator. In some aspects, strength and/or manner of actuation of the actuator is determined by strength of the signals received by the receiver or by a distance between the transmitter and the receiver. Typically, the system or haptic feedback system further allows the operator to engage the component to the component connector.

In some aspects, the feedback device further comprises a power source that is operable to provide power to the actuator. In certain aspects, the power source is further operable to provide power to the receiver. In some aspects, the feedback device is associated with at least one instrument operable to be worn by the operator. In certain of these aspects, the instrument is selected from the group consisting of: a glove, a finger pad, a finger band, a ring, a wrist band, a bracelet, a watch, an arm band, an article of clothing, a shoe, a hat, a head band, or other like wearable instrument. In some of these aspects, the instrument is a glove. In certain of these aspects, the haptic feedback is provided to the operator through from one to ten fingers of the glove. In certain aspects, the feedback device comprises two or more receiver and actuator pairs in which each of the two or more receiver and actuator pairs is operable to be worn by the operator on different digits of a hand of the operator. In some aspects, the feedback device comprises two or more receivers and/or two or more actuators. In certain aspects, the system or haptic feedback system includes two or more transmitters, wherein a first transmitter is associated with a first component connector and wherein a second transmitter is associated with a second component connector, wherein the first and second component connectors are different from one another, and wherein the actuator is operable to provide different haptic feedback to the operator when the receiver receives signals transmitted by the first transmitter, than when the receiver receives signals transmitted by the second transmitter.

In another aspect, the present disclosure provides a system or haptic feedback system to allow an operator to sense a first distance of a component (e.g., an aerospace and/or aircraft component) from a component connector (e.g., another aerospace and/or aircraft component, respectively). The system or haptic feedback system includes a transmitter associated with the component connector, and a feedback device operable to contact the operator. The feedback device comprises a receiver operable to receive signals transmitted by the transmitter, and an actuator operable to provide haptic feedback to the operator. In certain aspects, strength and/or manner of actuation of the actuator is determined by strength of the signals received by the receiver or by a second distance between the transmitter and the receiver. In some aspects, the first distance is the same as a second distance, which second distance is between the transmitter and the receiver, whereas in other aspects, the first distance differs from a second distance, which second distance is between the transmitter and the receiver. Typically, the system or haptic feedback system further allows the operator to engage the component to the component connector.

In another aspect, the present disclosure provides a system or haptic feedback system to allow an operator to sense a first distance and a direction of a feedback device from a transmitter. The system or haptic feedback system includes the transmitter associated with a target location, and the feedback device operable to contact the operator. The feedback device comprises a receiver operable to receive signals transmitted by the transmitter, and an actuator operable to provide haptic feedback to the operator in which strength, manner, or strength and manner of actuation of the actuator is determined by strength of the signals received by the receiver, or in which the strength, manner, or strength and manner of the actuation of the actuator is determined by a second distance between the transmitter and the receiver. In some aspects, the first distance is the same as the second distance, whereas in other aspects, the first distance differs from the second distance.

In some aspects, the feedback device further comprises a power source that is operable to provide power to the actuator. In certain aspects, the feedback device is associated with a glove operable to be worn by the operator. In some aspects, the feedback device comprises two or more receiver and actuator pairs in which each of the two or more receiver and actuator pairs is operable to be worn by the operator on different digits of a hand of the operator.

In another aspect, the present disclosure provides a system or haptic feedback system to allow an operator to determine distance of a component (e.g., an aerospace and/or aircraft component) from a component destination and subsequently engaging the component to the component destination. The system or haptic feedback system includes a target location where a component connector (e.g., another aerospace and/or aircraft component, respectively) is stationed, and a transmitter associated with the target location. The system or haptic feedback system also includes an operator band operable to be in contact with the operator. The operator band includes a receiver for receiving signals emitted by the transmitter and an actuator actuating on a skin of the operator in which a strength or manner of actuation is governed by the strength of the signal received by the receiver, and/or in which the strength or manner of actuation is function of the distance between the component and the component connector.

In another aspect, the present disclosure provides a non-optical method of connecting a component (e.g., an aerospace and/or aircraft component) to a component connector (e.g., another aerospace and/or aircraft component, respectively). The method includes receiving signals with a receiver of a feedback device operably contacted with an operator, which signals are transmitted by a transmitter associated with the component connector. The method also includes providing haptic feedback to the operator by actuating an actuator of the feedback device in response to the signals received by the receiver. The method also includes moving, by the operator, the receiver and the component toward the transmitter in response to the haptic feedback provided to the operator until the transmitter associated with the component connector is located. In addition, the method also includes connecting, by the operator, the component to the component connector. In some aspects, strength and/or manner of actuation of the actuator are determined by strength of the signals received by the receiver or by a distance between the transmitter and the receiver. In certain embodiments, the method further includes associating the transmitter with the component connector. In some aspects, the feedback device is associated with at least one instrument worn by the operator. In certain of these embodiments, the instrument is selected from the group consisting of: a glove, a finger pad, a finger band, a ring, a wrist band, a bracelet, a watch, an arm band, an article of clothing, a shoe, a hat, a head band, or other wearable instrument. In some of these embodiments, the instrument is a glove. In certain of these embodiments, the haptic feedback is provided to the operator through from one to ten fingers of the glove. In some aspects, the feedback device comprises two or more receiver and actuator pairs in which each of the two or more receiver and actuator pairs is worn on different digits of a hand of the operator. In some aspects, the feedback device comprises two or more receivers and/or two or more actuators. In certain aspects, the method includes using two or more transmitters, wherein a first transmitter is associated with a first component connector and wherein a second transmitter is associated with a second component connector, wherein the first and second component connectors are different from one another, wherein the actuator is operable to provide different haptic feedback to the operator when the receiver receives signals transmitted by the first transmitter, than when the receiver receives signals transmitted by the second transmitter, and wherein the method further comprises connecting, by the operator, a first component to the first component connector and a second component to the second component connector.

In another aspect, the present disclosure provides a computer readable media comprising non-transitory computer-executable instructions which, when executed by at least one electronic processor of a system or haptic feedback system perform at least: receiving signals with a receiver of a feedback device of the system or haptic feedback system, which signals are transmitted by a transmitter of the system or haptic feedback system, and providing haptic feedback to an operator by actuating an actuator of the feedback device of the system or haptic feedback system in response to the signals received by the receiver, wherein strength, manner, or strength and manner of actuation of the actuator are determined by strength of the signals received by the receiver or by a distance between the transmitter and the receiver.

DRAWINGS

The above and/or other aspects and advantages will become more apparent and more readily appreciated from the following detailed description of examples, taken in conjunction with the accompanying drawings, in which.

DETAILED DESCRIPTION

Figure 1:
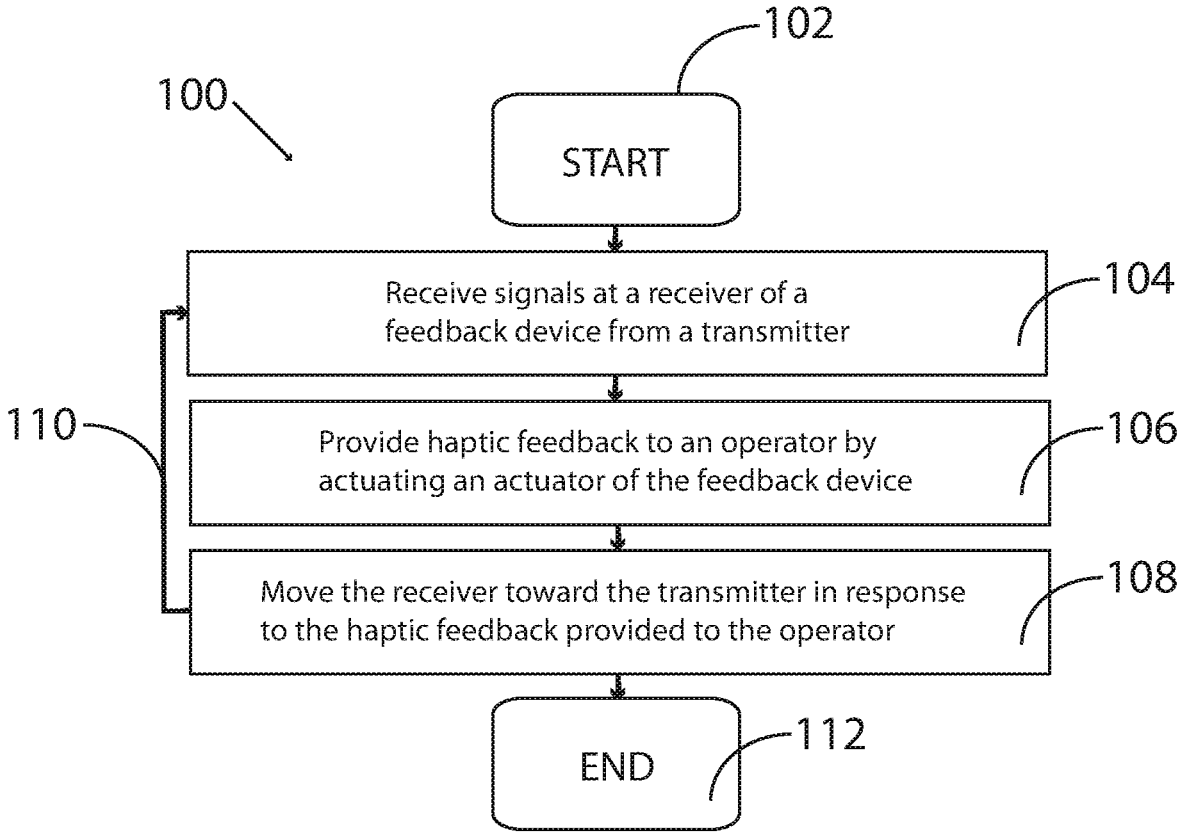
FIG. 1 is a flow chart that schematically depicts exemplary method steps of locating a transmitter according to some aspects disclosed herein.

Exemplary aspects will now be described more fully with reference to the accompanying drawings. Examples of the disclosure, however, may be embodied in many different forms and should not be construed as being limited to the examples set forth herein. Rather, these examples are provided so that this disclosure will be thorough and complete, and will fully convey the scope to those skilled in the art. In the drawings, some details may be simplified and/or may be drawn to facilitate understanding rather than to maintain strict structural accuracy, detail, and/or scale.

It will be understood that when an element is referred to as being "on," "associated with," "connected to," "electrically connected to," or "coupled to" to another component, it may be directly on, associated with, connected to, electrically connected to, or coupled to the other component or intervening components may be present. In contrast, when a component is referred to as being "directly on," "directly associated with," "directly connected to," "directly electrically connected to," or "directly coupled to" another component, there are no intervening components present. As used herein, the term "and/or" includes any and all combinations of one or more of the associated listed items.

It will be understood that although the terms first, second, etc., may be used herein to describe various elements, components, and/or directions, these elements, components, and/or directions should not be limited by these terms. These terms are only used to distinguish one element, component, and/or direction from another element, component, and/or direction. For example, a first element, component, or direction could be termed a second element, component, or direction without departing from the teachings of examples.

Spatially relative terms, such as "beneath," "below," "lower," "above," "upper," and the like may be used herein for ease of description to describe the relationship of one component and/or feature to another component and/or feature, or other component(s) and/or feature(s), as illustrated in the drawings. It will be understood that the spatially relative terms are intended to encompass different orientations of the device in use or operation in addition to the orientation(s) depicted in the figures.

As used herein, a given "component" and corresponding "component connector" refers to at least two components that are structured or otherwise operable to be joined, operably connected, or otherwise associated with one another. In certain aspects, one component is structured or otherwise operable to be joined, operably connected, or otherwise associated with multiple component connectors. In some embodiments, one component connector is structured or otherwise operable to be joined, operably connected, or otherwise associated with multiple components.

As used herein, the term "haptic feedback," "haptics," or "haptic effect" refers to any technology or communication mode that generates an experience of touch in an operator or other user by applying vibrations, pressures, temperatures, motions, and/or other forces to the operator or other user.

The terminology used herein is for the purpose of describing particular examples only and is not intended to be limiting of examples. As used herein, the singular forms "a," "an," and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which examples belong. It will be further understood that terms, such as those defined in commonly used dictionaries, should be interpreted as having a meaning that is consistent with their meaning in the context of the relevant art and should not be interpreted in an idealized or overly formal sense unless expressly so defined herein.

The present disclosure relates to systems for providing haptic feedback for confined manual manipulation of device or system components in tasks, such as aerospace and/or aircraft assembly and/or maintenance (e.g., wire routing, part installation, retrofit, maintenance, and upgrade) as well as for other applications. In the context of aerospace and/or aircraft maintenance or manufacture as just discussed, for example, the systems disclosed herein provide haptic feedback to an operator about the relative position and distance-to-target of their hand or other body part while reaching for a cable harness, connector, or other assembly. These haptic feedback systems cue the operator through haptic feedback applied to one or more fingers of one hand of the operator, thereby freeing the operator's other hand for other uses in certain aspects. In other aspects, haptic feedback is provided to both hands of a given operator depending on the application. In other aspects, haptic feedback is provided to other body parts, thereby freeing up one or both hands or other body parts to enable workers to proceed as necessary to perform the maintenance or assembly as needed. In these exemplary implementations, fixed viewing stations, borescopes, or other visualization aids are typically unnecessary. Examples herein allow the operator to contort and move as needed to reach the target location in an aerospace or aircraft maintenance or assembly without being burdened further with such equipment. As the components of the haptic feedback systems described herein are designed to be quickly installed at a given target location (e.g., an aerospace or aircraft component part or the like) and on the operator alike, the presently disclosed technology typically occupies a small footprint and is lightweight and inexpensive to fabricate when compared to other visual equipment routing aids (e.g., cameras, remote manipulators, and the like). The haptic feedback systems disclosed herein are generally of use in essentially any application where, for example, a line-of-sight to a given target location is obscured or otherwise difficult to ascertain unaided.

The haptic feedback systems disclosed herein typically preserve spatial fidelity better, and are less complicated, than, for example, a 2-D screen and unburden an operator with pointing a camera, watching a monitor, or the like. This also means that operators generally do not have to do any mental transformations, such as assessing orientation differences. In some implementations, the use of relatively simple electronics and hardware provides robust and inexpensive systems. These are often useful traits for environments, for example, contaminated with oils, fuels, grit, or having sharp edges/obstacles or other hazards.

In certain aspects, the systems disclosed herein include wearable feedback devices, such as wearable bands (e.g., rings, wristbands, etc.) containing sensors to determine relative distance (e.g., via signal strength), a controller to decode signal strength to haptic feedback, a power source, and an actuator to inform the operator via the haptic feedback. In certain aspects, the same or a different controller of a given system disclosed herein is operable to decode other parameters, such distances from a component and/or component connector, among other parameters. In some of these aspects, wearable bands are worn near the fingertips to provide enhanced fidelity for reaching and finding the target location. In some aspects, the wearable devices are embedded in or otherwise associated with a glove worn by the operator.

Essentially any power source is optionally utilized to provide power to these systems. In some aspects, for example, power is supplied to these systems via a battery (e.g., a rechargeable battery, a primary battery, or the like), by radio waves produced by a central unit, or by the transmitting signal of the target.

In some aspects, the feedback devices include a processor, receiver (e.g., a sensor, such as a radio frequency identification (RFID) tag or reader, global positioning system (GPS) device, ultrasonic transducer, wireless interface, infrared sensor, range sensor, depth sensor, and/or the like), bus, memory, and one or more actuators (e.g., haptic output devices) that are in electrical communication with one another.

The memory can include any suitable tangible and non-transitory computer-readable medium, such as ROM, RAM, EEPROM, or the like, and typically embodies program components that configure operation of the feedback device.

In certain aspects, the feedback device may further include one or more input/output (I/O) interface components and network interface devices.

Network interface device facilitate a network connection or otherwise facilitate communication between electronic devices. Some examples include, wireless interfaces such as, Bluetooth, near-field communication (NFC) interfaces, IEEE 802.11, RFID interfaces, or radio interfaces for accessing cellular telephone networks (e.g., transceiver/antenna for accessing a CDMA, GSM, UMTS, or other mobile communications network) and/or wired interfaces such as Ethernet, IEEE 1394, or USB. Other hardware devices that are optionally used in the haptic feedback systems disclosed herein, include universal asynchronous receiver-transmitters (UART) (e.g., RS232, RS422, RS485, etc.) for asynchronous serial communication.

The feedback devices also include actuators or other haptic output devices in communication with a controller, processor, and/or the receiver. In some aspects, the actuators or other haptic output devices are operable to output one or more haptic effects in response to signal received by receivers from transmitters. Essentially any actuator or haptic output device is optionally adapted for use in the haptic feedback systems disclosed herein. In certain aspects, the actuators or other haptic output devices are operable to output a haptic effect comprising a vibration, a simulated texture, a change in temperature, a change in a perceived coefficient of friction, an electro-tactile effect, a stroking sensation, a surface deformation, or other haptic effect. In some aspects, feedback devices use multiple actuators and/or other haptic output devices of the same or different types to produce one or more haptic effects. For example, multiple components and/or component connectors can be detected with variant haptic effects, such as varied vibrational frequencies, varied patterns of vibration, and the like associated with different components and/or component connectors.

In some aspects, the actuator or haptic output device is operable to output a vibration as the haptic effect. In these aspects, the actuator or haptic output device may include, for example, a piezoelectric actuator, an electro-magnetic actuator, an electric motor, a voice coil, a shape memory alloy, an eccentric rotating mass motor (ERM), an electro-active polymer, a solenoid, and/or a linear resonant actuator (LRA).

In certain aspects, the actuator or haptic output device is operable to output a haptic effect modulating the perceived coefficient of friction of a surface associated with the actuator or haptic output device. In some of these aspects, the actuator includes an ultrasonic actuator that vibrates at one or more ultrasonic frequencies, thereby increasing or decreasing the perceived coefficient of an associated surface.

In some aspects, the actuator or haptic output device uses electrostatic attraction (e.g., via an electrostatic actuator) to output a haptic effect. In these aspects, the haptic effect may include a simulated texture, a stroking sensation, a simulated vibration, or a perceived change in a coefficient of friction on a surface associated with the feedback device, such as the hand of an operator or other user. In certain aspects, the electrostatic actuator includes a conducting layer and an insulating layer. The conducting layer may be any semiconductor or other conductive material, such as copper, gold, aluminum, or silver. The insulating layer may be plastic, polymer, glass, or any other insulating material. A processor or controller of the feedback device generally operates the electrostatic actuator by applying an electric signal (e.g., an alternating current (AC) signal) to the conducting layer. The electric signal typically generates a capacitive coupling between the conducting layer and the operator (e.g., one or more of the operator's fingers) near or touching the actuator or haptic output device. Varying the levels of attraction between the operator's fingers and the conducting layer can vary the haptic effect perceived by the operator.

In other exemplary aspects, an actuator or haptic output device includes a deformation device that is operable to output a deformation haptic effect. The deformation haptic effect typically includes raising or lowering portions of a surface associated with the feedback device to create perceived texture variations, such as folding, bending, rolling, squeezing, twisting, flexing, changing the shape of, or otherwise deforming the surface associated with the feedback. In some of these aspects, the actuator may include a rotating/linear actuator, a solenoid, a piezo-electric actuator, a macro fiber composite (MFC) actuator, an electroactive polymer actuator, a shape memory alloy (SMA) actuator, and/or the like.

The target (e.g., an aerospace and/or aircraft component part or the like) also typically has a similar relatively cheap, simple unit or transmitter that sends a signal to the receivers of the wearable feedback devices. In some aspects, the transmitter also has a band-like shape to facilitate its quick and secure attachment to cables, connectors, protrusions, or the like. A signal transmitted from a transmitter is generally interpreted via a feedback device receiver to indicate the transmitter's distance and/or direction from the operator. In some aspects, this signal is not encoded, whereas in other aspects the signal is encoded. The transmitter typically includes the radiating element, a power source, and a controller. In some aspects, the transmitter does not include any onboard logic or processing.

The transmitter associated with a target (e.g., an aerospace and/or aircraft component part or the like) emits (e.g., wirelessly transmits signal) the locating signal to feedback devices typically in communication with the operator's hand, thereby simplifying the operator's "control loop" compared to, for example, visual systems. The haptic feedback systems disclosed herein also help to prevent operator confusion created, for example, when multiple similar targets are present by uniquely identifying each individual signal using different haptic feedback outputs. The haptic feedback systems can communicate and be powered in numerous different ways to enable aspects for different situations or applications.

In some aspects, the transmitter (e.g., a transmitting band) includes an output/radiating element, optional controller, a power storage device and/or a power input device, a conformable band (e.g., Velcro® strap, silicone rubber strap, etc.), and optional indicating LEDs. In certain aspects, the feedback device includes a receiver having an input element/antenna, a digital controller and/or analog circuitry, a power storage device and/or a power input device, a conformable, wearable band (e.g., Velcro® strap, silicone rubber strap, etc.), and an electromechanical transducer or actuator (e.g., piezoelectric actuator, linear resonant actuator (LRA), eccentric rotating mass (ERM) actuator, off-balance motor, or the like). In some aspects, the distance between the receiver and transmitter is determined using an electro-optical distance measuring device. In certain aspects, an external power source is used for the transmitter and receiver. In some aspects, a remote control component is used for selecting among multiple transmitting targets.

Typically, the transmitter (e.g., a transmitting band) serves to identify the target (e.g., aerospace and/or aircraft component part or the like) that it is associated with and creates the signal for the receivers to receive. The power source generally powers operation of the haptic feedback system and typically defines the range/duration of a given application. In some aspects, the receiver provides proportional feedback to the operator or user based on range-to-target, either through increasing or diminishing mechanical actuation of the actuator as the range decreases. The receiver (e.g., an antenna), controller, circuitry, and power source of the feedback device effectuate this haptic feedback.

In some aspects, a given transmitting/receiving pair (e.g., a transmitter associated with a target and a receiver of a feedback device) are coupled through several electromagnetic or mechanical means, including infrared (IR) LEDs and photocouplers, radio frequency (RF) transmissions and antenna, ultrasonic transducers and microphones, visible LEDs, and the like. The transmissions are typically continuous, so that the limiting feedback bandwidth is the time constant of the mechanical transducer. Although optionally utilized, locating through round-trip timing methods generally adds computational complexity, as well as lag and discrete update rates.

In the case of RF transmission, tuning or alternate versions can be produced to indicate the presence of line voltage on cables, so that operators may be alerted in advance to hazardous conditions and to effect electrical safety usage. This aspect is similar to stand-alone testers, but with the receivers are worn under or integrated into gloves in certain instances so that this safeguard is continually present.

FIG. 1 is a flow chart that schematically depicts exemplary method steps of locating a transmitter according to some aspects disclosed herein. As shown, method 100 starts (step 102) when signals are received at a receiver of a feedback device from a transmitter in step 104. The feedback device is typically worn on the hand of an operator in the form of one or more wearable bands or rings positioned on the digits of the hand or integrated into a glove worn by the operator. In some aspects, the feedback device includes two or more receiver and actuator pairs in which each of the pairs is worn on different digits of the operator's hand. In certain aspects, the feedback device comprises multiple receivers operable to receive signals transmitted from one or more transmitters. The transmitter is generally associated with a target, such as a component (e.g., a first component) or a component connector (e.g., a second component). For example, the transmitter may be integrated into a removable strap or band that is wrapped around the component or a component connector. In some aspects, the haptic feedback systems disclosed herein include multiple transmitters operable to transmit signals to one or more receivers of a given feedback device.

As additionally shown, method 100 also includes providing haptic feedback (e.g., a mechanical vibration or other effect) to the operator by actuating an actuator of the feedback device (step 106) in response to the signals received by the receiver in step 104. The haptic feedback provides the operator with an indication of the receiver's and/or operator's hand's proximity to the transmitter and accordingly, to the target. In some aspects, the strength, manner, or strength and manner of actuation of the actuator are determined by strength of the signals received by the receiver and/or by a distance between the transmitter and the receiver. Method 100 also includes moving the operator's hand, associated with the receiver of the feedback device, toward the transmitter in response to the haptic feedback provided to the operator to thereby locate the transmitter and thus, also the target in step 108. As shown, method 100 is typically performed as a repeating loop (step 110) until the transmitter is located. Although not shown, method 100 also typically includes connecting the component (e.g., a first component) to the component connector (e.g., a second component) upon locating the transmitter (e.g., as part of a maintenance or assembly process or other application) and then ends with step 112.

Figure 2:
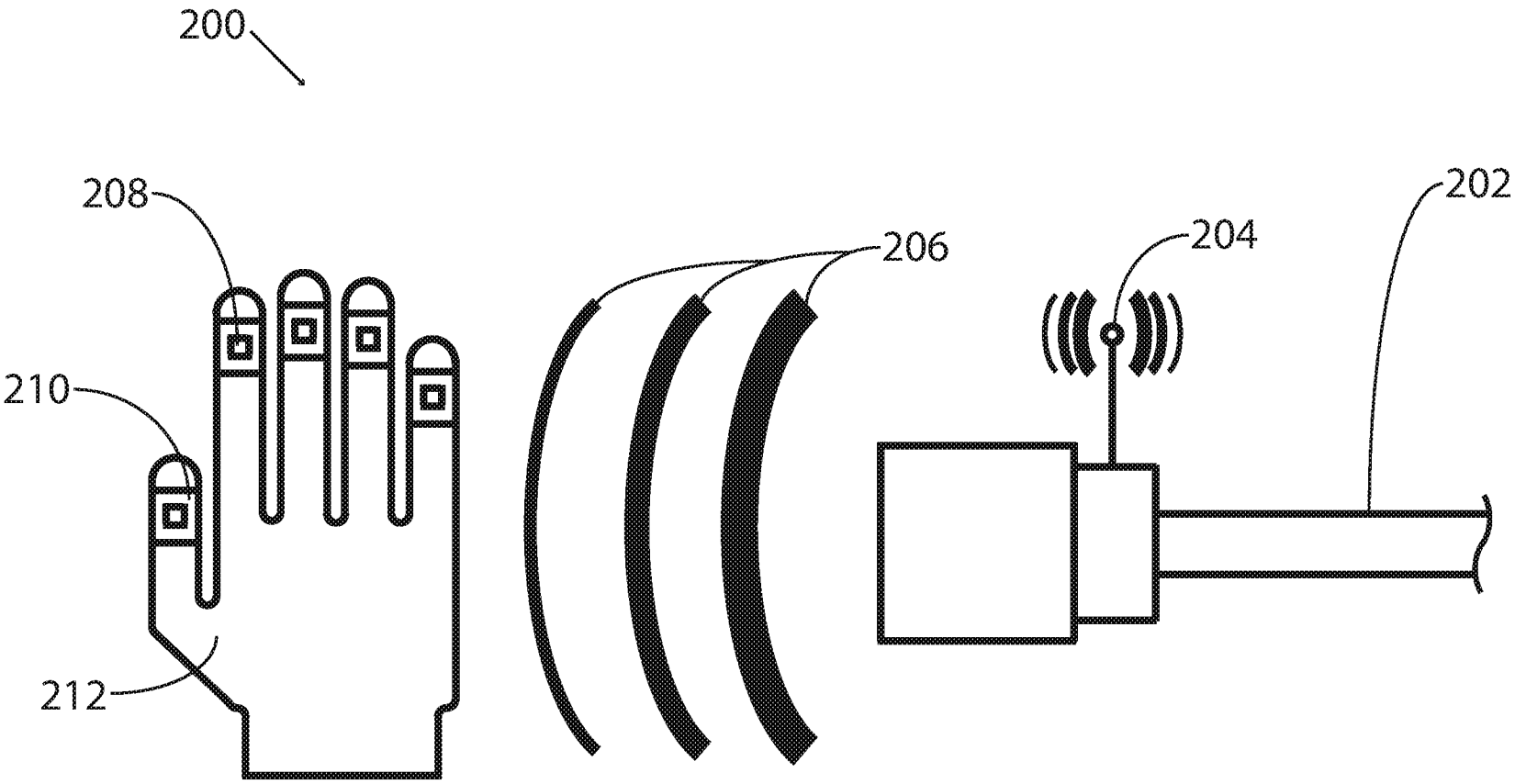
FIG. 2 is a schematic diagram of an exemplary haptic feedback system suitable for use with certain aspects disclosed herein.

To further illustrate, FIG. 2 schematically depicts a haptic feedback system according to one exemplary aspect. As shown, system 200 includes transmitter 204 associated with cable harness 202, which is to be routed. Transmitter 204 transmits signal 206 which becomes less intense as it travels away from transmitter 204. Individual feedback devices 208 are positioned on and in contact with each finger of operator's hand 212 via wearable bands 210. Feedback devices 208 translate the signal intensity into haptic feedback, thus allowing per-finger guidance to the target cable harness. Based on the haptic feedback (signal strength), the operator can move away from or toward the target location (e.g., position of transmitter 204 on cable harness 202). In some aspects, feedback devices 208 provide proportional feedback to the operator based on range-to-target, either through increasing or decreasing mechanical actuation as the range decreases.

Figure 3:
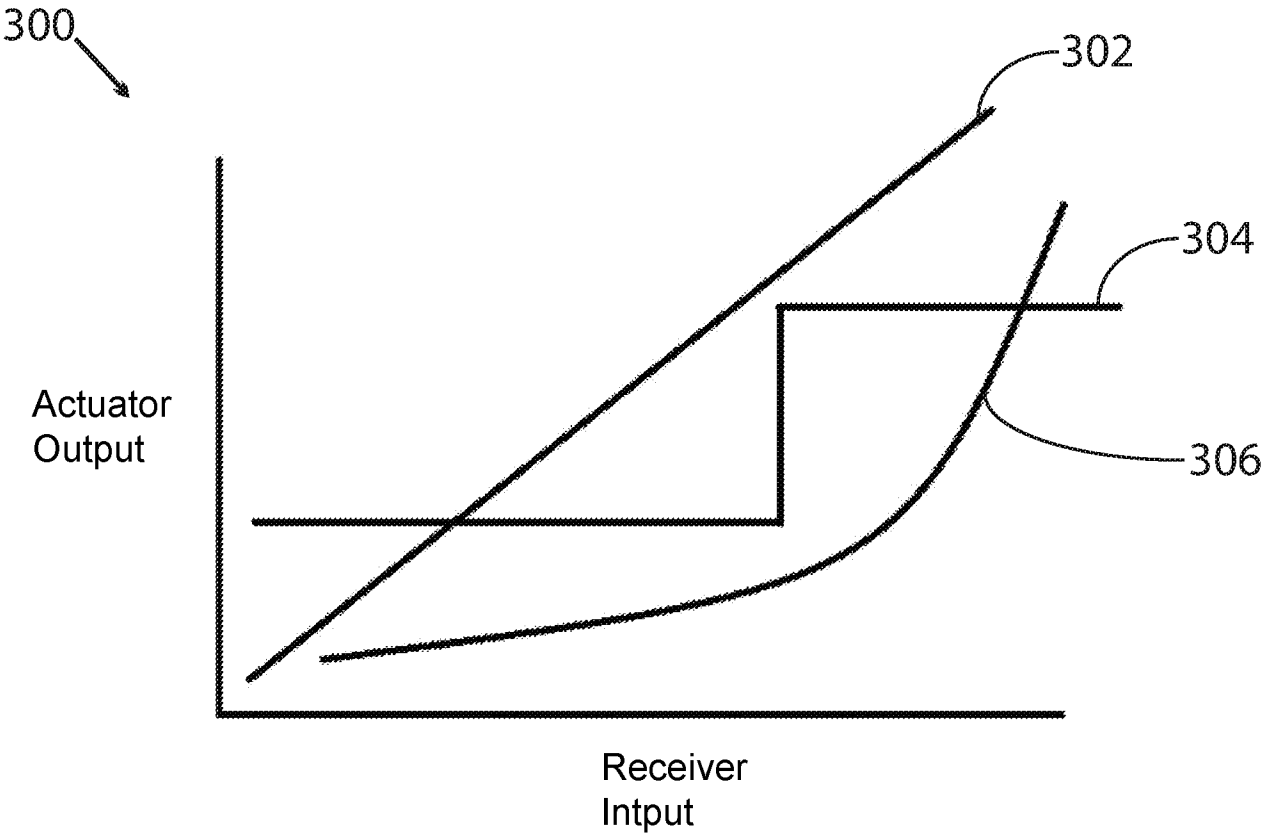
FIG. 3 is a schematic graph plotting receiver input and actuator output according to some aspects disclosed herein.

Although not within view, each feedback device 208 of system 200 includes a receiver (e.g., a sensor or antenna), a controller and related circuitry to decode signal strength to haptic feedback, an actuator to provide the haptic feedback to the operator regarding the proximity of the operator's hand 212 to transmitter 204 (and accordingly, also to cable harness 202), and a power source, while transmitter 204 includes a radiating element, power source, and a controller. Wearable bands 210 can be color-coded, illuminated, or fluorescent to aid routing and identify TX/RX bands. Different sizes or adjustable ranges can be made without hardware changes. The wearable bands provide haptic feedback to the operator to enable the operator to determine the distance and/or direction of the operator's hand 212 from a target, such as cable harness 202 or another component connector. To further illustrate, FIG. 3 is a schematic graph plotting receiver input and actuator output according to some aspects disclosed herein. As shown, graph 300 depicts exemplary modes of providing haptic feedback in which the strength or intensity of vibration (or any other output signal) increases linearly (302), exponentially (306), or in a stepped response (304) upon reaching and/or exceeding selected thresholds with respect to signal strength, distance, safety of the component connector, or a combination of these factors. In certain applications, for example, as the distance between a receiver and a transmitter decreases, the signal strength transmitted from the transmitter to the receiver increases. In response, the intensity of haptic feedback generated by the actuator also increases either linearly, exponentially, or in a stepped response as shown in FIG. 3, in this particular example. In some aspects, the methods described herein are implemented via related computer readable media.

Figure 4:
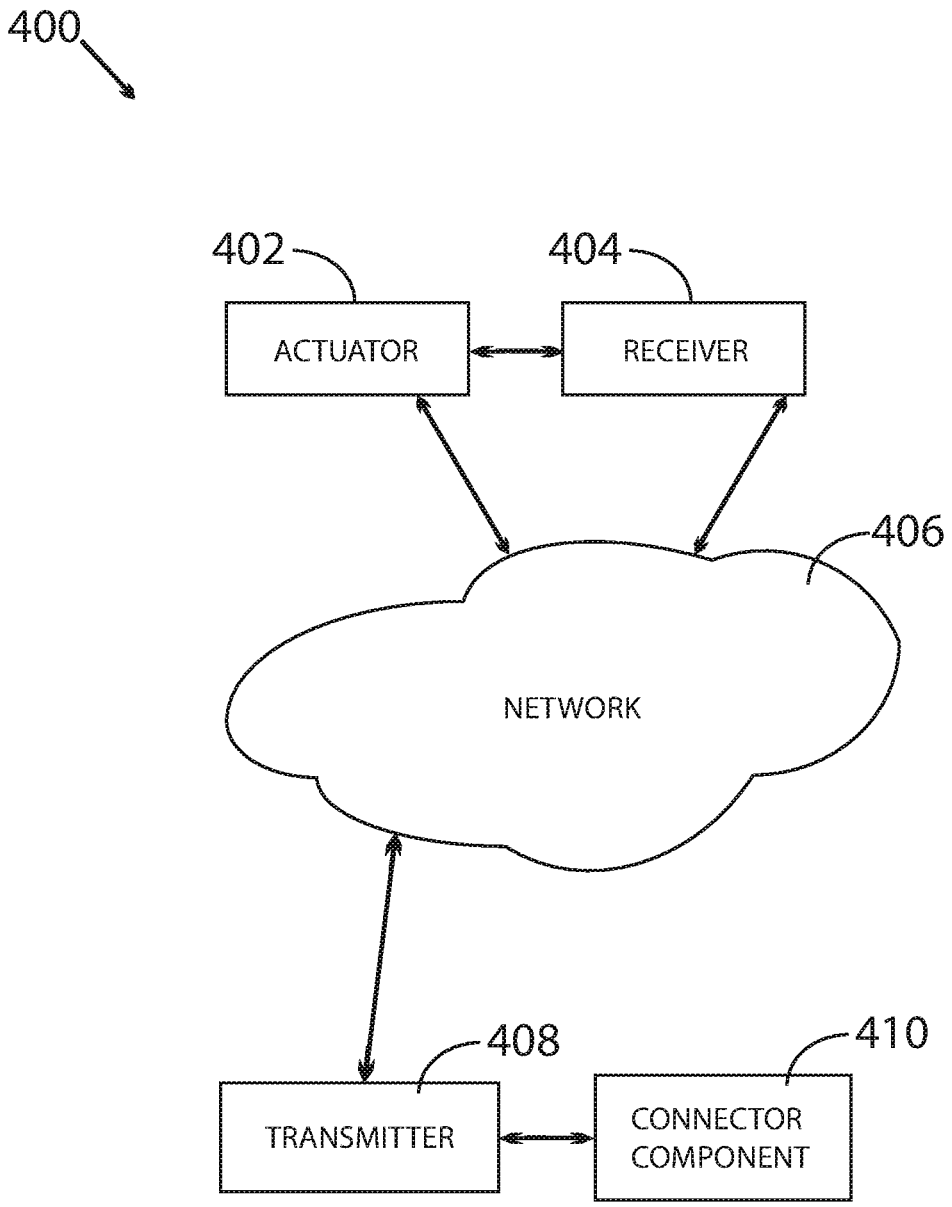
FIG. 4 is a schematic diagram of an exemplary haptic feedback system suitable for use with certain aspects disclosed herein.

FIG. 4 is a schematic diagram of an exemplary system suitable for use with certain aspects disclosed herein. As shown, system 400 include a feedback device that includes actuator 402 and receiver 404, which are in communication with one another. System 400 also includes transmitter 408, which is removably associated with connection component 410. Actuator 402, receiver 404, and/or transmitter 408 may be connected to network 406. Network 406 can be essentially any number or type of networks or links, including, for example, a WiFi network, a local area network (LAN), a cellular network, wide area network (WAN), public switched telephone network (PSTN), a dial-up network, the Internet, an intranet or any combination of hard-wired and/or wireless communication links. In certain aspects, network 406 is a single network, whereas in others, network 406 includes multiple networks. Actuator 402, receiver 404, and/or transmitter 408 may directly communicate with each other and/or may communicated with each other via network 406. In certain aspects, for example, actuator 402, receiver 404, and/or transmitter 408 communicate with one or more remote servers (e.g., webservers, cloud servers, or other servers), databases, and/or computing devices via network 406.

While the foregoing disclosure has been described in some detail by way of illustration and example for purposes of clarity and understanding, it will be clear to one of ordinary skill in the art from a reading of this disclosure that various changes in form and detail can be made without departing from the true scope of the disclosure and may be practiced within the scope of the appended claims. For example, all the methods, systems, and/or component parts or other aspects thereof can be used in various combinations. All patents, patent applications, websites, other publications or documents, and the like cited herein are incorporated by reference in their entirety for all purposes to the same extent as if each individual item were specifically and individually indicated to be so incorporated by reference.

What is claimed is:

1. A haptic feedback system to allow an operator to sense distance of a component from a component connector, the haptic feedback system comprising:

a transmitter associated with the component connector; and a feedback device operable to contact the operator;

wherein the feedback device comprises two or more receiver and actuator pairs and wherein a given receiver and actuator pair comprises:

a receiver operable to receive signals transmitted by the transmitter; and an actuator operable to provide haptic feedback to the operator; and, wherein each of the two or more receiver and actuator pairs is operable to be worn by the operator on different digits of a hand of the operator.

2. The haptic feedback system of claim 1, wherein strength and/or manner of actuation of the actuators are determined by strength of the signals received by the receivers or by a distance between the transmitter and the receivers.

3. The haptic feedback system of claim 1, wherein the haptic feedback system further allows the operator to engage the component to the component connector.

4. The haptic feedback system of claim 1, wherein the feedback device further comprises a power source that is operable to provide power to each of the actuators.

5. The haptic feedback system of claim 4, wherein the power source is further operable to provide power to each of the receivers.

6. The haptic feedback system of claim 1, wherein the feedback device is associated with at least one instrument operable to be worn by the operator.

7. The haptic feedback system of claim 6, wherein the instrument is a glove, a finger pad, a finger band, a ring, a wrist band, a bracelet, a watch, an arm band, an article of clothing, a shoe, a hat, or a head band.

8. The haptic feedback system of claim 6, wherein the instrument is a glove.

9. The haptic feedback system of claim 8, wherein the haptic feedback is provided to the operator through from one to ten fingers of the glove.

10. The haptic feedback system of claim 1, comprising two or more transmitters, wherein a first transmitter is associated with a first component connector and wherein a second transmitter is associated with a second component connector, wherein the first and second component connectors are different from one another, and wherein each of the actuators are operable to provide different haptic feedback to the operator when each of the receivers receive signals transmitted by the first transmitter, than when each of the receivers receive signals transmitted by the second transmitter.

11. A haptic feedback system to allow an operator to sense a first distance of a component from a component connector, the haptic feedback system comprising:

a transmitter associated with the component connector; and a feedback device operable to contact the operator;

wherein the feedback device comprises two or more receiver and actuator pairs and wherein a given receiver and actuator pair comprises:

a receiver operable to receive signals transmitted by the transmitter; and an actuator operable to provide haptic feedback to the operator; and, wherein each of the two or more receiver and actuator pairs is operable to be worn by the operator on different digits of a hand of the operator.

12. The haptic feedback system of claim 11, wherein strength and/or manner of actuation of each of the actuators are determined by strength of the signals received by each of the receivers or by a second distance between the transmitter and the receivers.

13. The haptic feedback system of claim 11, wherein the first distance is the same as a second distance, which second distance is between the transmitter and at least one of the receivers.

14. The haptic feedback system of claim 11, wherein the first distance differs from a second distance, which second distance is between the transmitter and at least one of the receivers.

15. The haptic feedback system of claim 11, wherein the haptic feedback system further allows the operator to engage the component to the component connector.

16. The haptic feedback system of claim 11, wherein the feedback device further comprises a power source that is operable to provide power to each of the actuators, the receivers or both.

17. The haptic feedback system of claim 11, wherein the feedback device is associated with an instrument operable to be worn by the operator, and wherein the instrument is a glove, a finger pad, a finger band, a ring, a wrist band, a bracelet, a watch, an arm band, an article of clothing, a shoe, a hat, or a head band.

18. The haptic feedback system of claim 17, wherein the instrument is a glove and wherein the haptic feedback is provided to the operator through from one to ten fingers of the glove.

19. The haptic feedback system of claim 11, comprising two or more transmitters, wherein a first transmitter is associated with a first component connector and wherein a second transmitter is associated with a second component connector, wherein the first and second component connectors are different from one another, and wherein each of the actuators are operable to provide different haptic feedback to the operator when each of the receivers receive signals transmitted by the first transmitter, than when each of the receivers receive signals transmitted by the second transmitter.

20. A non-optical method of connecting a component to a component connector, the method comprising:

receiving signals with a receiver of a feedback device operably contacted with an operator, which signals are transmitted by a transmitter associated with the component connector, wherein the feedback device comprises two or more receiver and actuator pairs, and wherein each of the two or more receiver and actuator pairs is worn by the operator on different digits of a hand of the operator; and wherein a given receiver and actuator pair comprises:

a receiver operable to receive signals transmitted by the transmitter; and an actuator operable to provide haptic feedback to the operator; and, providing haptic feedback to the operator by actuating each of the actuators of the two or more receiver and actuator pairs of the feedback device in response to the signals received by each of the receivers;

moving, by the operator, each of the receivers and the component toward the transmitter in response to the haptic feedback provided to the operator until the transmitter associated with the component connector is located; and, connecting, by the operator, the component to the component connector.

21. The method of claim 20, wherein strength and/or manner of actuation of each of the actuators are determined by strength of the signals received by each of the receivers or by a distance between the transmitter and each of the receivers.

22. The method of claim 20, further comprising associating the transmitter with the component connector.

23. The method of claim 20, wherein the feedback device is associated with at least one instrument worn by the operator, and where the instrument is a glove, a finger pad, a finger band, a ring, a wrist band, a bracelet, a watch, an arm band, an article of clothing, a shoe, a hat, or a head band.

24. The method of claim 23, wherein the instrument is a glove, and wherein the haptic feedback is provided to the operator through from one to ten fingers of the glove.

25. The method of claim 23, wherein each of the two or more receiver and actuator pairs is worn by the operator on different digits of a hand of the operator.

26. A haptic feedback system to allow an operator to sense distance of components from component connectors, the haptic feedback system comprising:

two or more transmitters, wherein a first transmitter is associated with a first component connector and wherein a second transmitter is associated with a second component connector, and wherein the first and second component connectors are different from one another; and a feedback device operable to contact the operator;

wherein the feedback device comprises:

a receiver operable to receive signals transmitted by the transmitters; and an actuator operable to provide haptic feedback to the operator.

27. A non-optical method of connecting a component to a component connector, the method comprising:

receiving signals with a receiver of a feedback device operably contacted with an operator, which signals are transmitted by two or more transmitters, wherein a first transmitter is associated with a first component connector and wherein a second transmitter is associated with a second component connector, and wherein the first and second component connectors are different from one another;

providing haptic feedback to the operator by actuating an actuator of the feedback device in response to the signals received by the receiver;

moving, by the operator, the receiver and the component toward the transmitter in response to the haptic feedback provided to the operator until the transmitter associated with the component connector is located; and, connecting, by the operator, the component to the component connector.

* * * * *